US008780001B2

(12) United States Patent
Lee

(10) Patent No.: US 8,780,001 B2
(45) Date of Patent: Jul. 15, 2014

(54) ASYMMETRICAL DIPOLE ANTENNA

(75) Inventor: Chang-Jung Lee, Taoyuan County (TW)

(73) Assignee: Accton Technology Corporation, Hsinchu (TW)

( * ) Notice: Subject to any disclaimer, the term of this patent is extended or adjusted under 35 U.S.C. 154(b) by 283 days.

(21) Appl. No.: 13/347,157

(22) Filed: Jan. 10, 2012

(65) Prior Publication Data

US 2012/0176289 A1 Jul. 12, 2012

(30) Foreign Application Priority Data

Jan. 10, 2011 (TW) ..... 100100823 A

(51) Int. Cl.
*H01Q 19/10* (2006.01)

(52) U.S. Cl.
USPC ..... 343/818

(58) Field of Classification Search
USPC ..... 343/818, 807, 821, 830, 793–797
See application file for complete search history.

(56) References Cited

U.S. PATENT DOCUMENTS

| | | | | |
|---|---|---|---|---|
| 4,843,463 | A * | 6/1989 | Michetti | 348/148 |
| 5,872,546 | A * | 2/1999 | Ihara et al. | 343/795 |
| 6,211,840 | B1 * | 4/2001 | Wood et al. | 343/793 |
| 7,209,089 | B2 * | 4/2007 | Schantz | 343/787 |
| 7,471,256 | B2 * | 12/2008 | Kwon et al. | 343/795 |
| 2010/0141545 | A1 * | 6/2010 | Pakosz et al. | 343/810 |

* cited by examiner

*Primary Examiner* — Huedung Mancuso
(74) *Attorney, Agent, or Firm* — Muncy, Geissler, Olds & Lowe, P.C.

(57) ABSTRACT

An asymmetrical dipole antenna is provided. A radiation module and a ground module are formed by a metallic conductor and arranged at an interval on a substrate of the antenna, and the radiation module and the ground module, respectively, have a radiation base and a ground base. Two radiation arms and two ground arms are formed by extending from two ends of the two respective bases in opposite directions. The two radiation arms are orthogonal to the radiation base, and the second radiation arm is bent and extended toward the first radiation arm to form an arc opened toward the first radiation arm. The two ground arms are orthogonal to the ground base, and a hook is formed by extending and bending the second ground arm toward the first ground arm. A feeder unit connects the feed point and the ground point of the two bases.

9 Claims, 7 Drawing Sheets

| | Horizontal | Vertical | Integrated |
|---|---|---|---|
| Maximum gain | -2.1 | 0.5 | 2.04 |
| Maximum gain@angle | 11 | 139 | 13 |
| Minimum gain | -33.34 | -3.21 | -2.94 |
| Minimum gain@angle | 265 | 303 | 296 |
| Average gain | -5.6 | -0.77 | 0.46 |

| | Horizontal | Vertical | Integrated |
|---|---|---|---|
| Maximum gain | 0.55 | -2.17 | 2.09 |
| Maximum gain@angle | 207 | 230 | 207 |
| Minimum gain | -2939 | -4.98 | -4.85 |
| Minimum gain@angle | 275 | 93 | 93 |
| Average gain | -3.37 | -3.36 | -0.37 |

| | Horizontal | Vertical | Integrated |
|---|---|---|---|
| Maximum gain | -18.24 | 2.76 | 2.77 |
| Maximum gain@angle | 255 | 0 | 0 |
| Minimum gain | -42.59 | -4.26 | -4.17 |
| Minimum gain@angle | 189 | 105 | 105 |
| Average gain | -24.46 | 0.92 | 0.91 |

| | Horizontal | Vertical | Integrated |
|---|---|---|---|
| Maximum gain | 3.52 | -3.36 | 4.28 |
| Maximum gain@angle | 206 | 180 | 204 |
| Minimum gain | -23.82 | -24.17 | -16.53 |
| Minimum gain@angle | 104 | 75 | 104 |
| Average gain | -1.37 | -8.48 | -0.65 |

ASYMMETRICAL DIPOLE ANTENNA

CROSS-REFERENCE TO RELATED APPLICATION

This application claims the benefit of Taiwan Patent Application No. 100100823, filed on Jan. 10, 2011, which is hereby incorporated by reference for all purposes as if fully set forth herein.

BACKGROUND OF THE INVENTION

1. Field of Invention

The present disclosure relates to an antenna structure, and more particularly to an asymmetrical dipole antenna applicable to different types of radio signal transmission.

2. Related Art

In current antenna structures, an omnidirectional antenna is very useful in various radio communication apparatuses since a radiation mode supports desirable transmission and reception effects in a mobile unit. In order to improve gain of the omnidirectional antenna and impedance matching of the antenna, mostly wide feed wires or loop circuits are used in the arrangement to design a radiation portion and a ground portion.

However, the use of a feed wire or a loop circuit has disadvantages. If a feed wire is too wide, the transmitted may affect the signal of the radiation portion and cause a coupling effect between the feed wire and the radiation portion. Moreover, the impedance matching of the antenna component is affected, and the width of a frequency band is limited. If spacing between the feed wire and the radiation portion is increased, the omnidirectional antenna's directivity in a certain direction easily becomes too high. On the other hand, although the loop circuit achieves high impedance, the manufacturing process is more difficult and thus the yield rate of the manufactured antenna is reduced.

Regardless of the type of antenna, as long as the antenna is disposed in a region with a physiographic barrier (such as a corner or a ceiling), gain values in specific directions are insufficient and poor communication quality occurs in signal reception and transmission. Therefore, the issue of how to reduce the complexity of manufacturing the antenna while maintaining or further improving the antenna gain is an issue that the manufacturers should pay attention to.

SUMMARY OF THE INVENTION

Accordingly, the embodiment is directed to an antenna structure with simple structure that maintains high gain.

In order to solve the above problems in the antenna structure, the embodiment provides an asymmetrical dipole antenna with a substrate, a radiation module, a ground module and a feeder unit. The radiation module has a radiation base and is formed by a first metallic conductor arranged on the substrate. The first radiation arm and a second radiation arm extend toward a first direction from two ends of the radiation base in an orthogonal manner. The second radiation arm bends and extends toward the first radiation arm, so as to form an arc opened toward the first radiation arm with the radiation base. The radiation base has a feed point. The ground module, which corresponds to the radiation module at an interval, has a ground base and is formed by a second metallic conductor arranged on the substrate. A first ground arm and a second ground arm are orthogonal to the ground base, and extend toward a second direction from two different ends of the ground base. The second ground arm is a hook extending toward the first ground arm. A ground point is arranged on the ground base corresponding to the feed point. The feeder unit electrically connects the feed point and the ground point.

In order to solve the above problems in the antenna structure, the embodiment further provides another asymmetrical dipole antenna, which comprises a substrate, a radiation module, a ground module, and a feeder unit. The structure is similar to the above structure, but there is an additional transition portion having an indented notch at a position where the ground base extends to the first ground arm.

In order to solve the above problems in the antenna structure, the embodiment further provides a third asymmetrical dipole antenna, which comprises a substrate, a radiation module, a ground module, a feeder unit, and a reflective layer. This embodiment differs from the previous structures because of the substrate structure and reflective layer.

The substrate has a first surface and a second surface which are opposite to each other. The radiation module is formed by a first metallic conductor arranged on the first surface. The second radiation arm varies in width from broad to narrow and extends toward the first radiation arm, so as to form an arc opened toward the first radiation arm with the radiation base. The ground module, which corresponds to the radiation module at an interval, has a ground base and is formed by a second metallic conductor arranged on the first surface. The reflective layer is arranged on the second surface of the substrate.

The embodiment has the following features. Firstly, the antenna structure of the embodiment is different from the structure in the prior art and has desirable gain effect through the structure thereof even if the antenna is applied and disposed in a region with a physiographic barrier (such as a corner or a ceiling). Upon testing, the pattern of the antenna is not easily affected. Since the blind spots (concave and convex points) are relatively shallow and the radiation pattern is relatively circular, poor communication quality does not easily occur in signal reception and transmission. Secondly, the antenna structure of the embodiment has a simpler structure than that of a loop circuit, and thus effectively reduces the complexity of manufacturing the antenna. Thirdly, the antenna structure of the embodiment meets the design requirements of a current dual-frequency dual-polarization antenna, the requirements for multi-frequency transmission capabilities, and the gain requirements, thereby greatly improving the applicability thereof.

BRIEF DESCRIPTION OF THE DRAWINGS

The embodiment will become more fully understood from the detailed description given herein below for illustration only, and thus are not limitative of the embodiment, and wherein.

DETAILED DESCRIPTION OF THE INVENTION

Preferred embodiments are illustrated in detail below with reference to the accompanying drawings.

Figure 1:
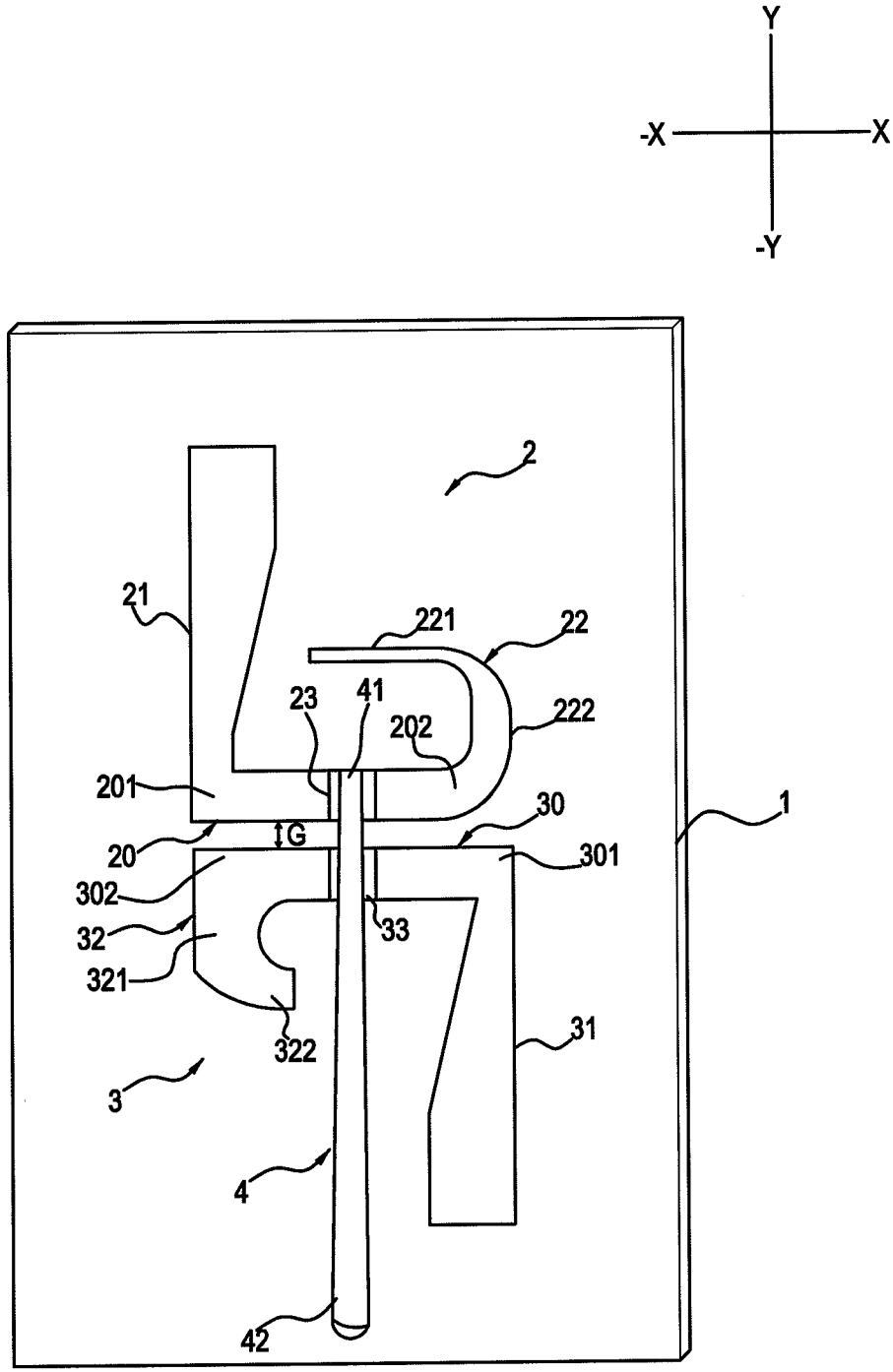
FIG. 1 is a drawing illustrating a first architecture of an asymmetrical dipole antenna according to an embodiment.

FIG. 1 is a drawing illustrating a first architecture of an asymmetrical dipole antenna according to an embodiment. In FIG. 1, the asymmetrical dipole antenna includes a substrate 1, a radiation module 2, a ground module 3, and a feeder unit 4. The illustration is provided below in conjunction with the reference directions in FIG. 1.

The radiation module 2 is formed by a first metallic conductor arranged on the substrate 1, and the ground module 3 is formed by a second metallic conductor arranged on the substrate 1. The forming method may be circuit board etching, molten metal vapor deposition, metal sputtering, metal coating, and other relevant applicable methods.

The radiation module 2 has a radiation base 20 and a feed point 23 disposed therein. The first radiation arm 21 extends toward a direction from the first end 201 of the radiation base 20. A second radiation arm 22 extends toward the first direction from the second end 202 of the radiation base 20. The first direction, for example, is a +Y direction herein.

As shown in FIG. 1, the first radiation arm 21 is orthogonal to the radiation base 20. The second radiation arm 22 bends and extends toward the first radiation arm 21 after extending out from the second end 202 of the radiation base 20 and forms an arc opened toward the first radiation arm 21 with the radiation base 20.

The ground module 3 corresponds to the radiation module 2 at an interval and is arranged on the substrate 1. The arrangement position of the ground module 3 aligns with the arrangement position of the radiation module 2. The ground module 3 includes a ground base 30 and a ground point 33 is disposed therein. The arrangement position of the ground point 33 aligns with the arrangement position of the feed point 23. A gap G exists between the ground base 30 and the radiation base 20, and the size of the gap G is adjusted according to impedance matching and gain of the antenna. A first ground arm 31 extends toward a second direction from the first end 301 of the ground base 30. A second ground arm 32 extends toward the second direction from the second end 302 of the ground base 30. The second direction is opposite to the first direction, and is a −Y direction in this embodiment.

As shown in FIG. 1, the first ground arm 31 is orthogonal to the ground base 30. The second ground arm 32 slightly bends and extends toward the first ground arm 31 after extending out from the ground base 30, forming a hook. The inner edge of the second ground arm 32 indents in an arc shape similar to the inside of a hook.

As for the arrangement positions of the components, the arrangement position of the first ground arm 31 aligns with the second radiation arm 22, and the arrangement position of the second ground arm 32 aligns with the first radiation arm 21, so that the radiation module 2 and the ground module 3 form an asymmetrical arrangement.

The feeder unit 4 electrically connects the feed point 23 and the ground point 33, and a straight rod-shaped feeder arm is taken as an example for description herein. In this embodiment, the feeder arm is arranged in a Y axis direction and has a feeder (not shown) therein. The feeder is connected from the first end 41 of the feeder arm to the feed point 23 and the ground point 33 and extends out through a second end 42 of the feeder arm to form an electrical connection to a related circuit, electronic component, or device.

In order to cater to the adjustment related to impedance and gain, the antenna structure may be correspondingly changed and designed. Some examples are given below.

(1) The position of the feed point 23 is defined so that the length from the feed point 23 to the farther end of the first radiation arm 21 is equal to the length from the feed point 23 to the farther end of the second radiation arm 22.

(2) The position of the ground point 33 is defined so that the length from the ground point 33 to the far end of the first ground arm 31 is twice the length from the ground point 33 to the far end of the second radiation arm 22, which is the end of the hook.

(3) The shape of the second radiation arm 22 is defined as follows. After the second radiation arm 22 extends out from the radiation base 20, the second radiation arm 22 is in an arc shape varying from broad to narrow width. Herein, the second radiation arm 22 is divided into two segments: a first segment 221 and a second segment 222 which are perpendicular to each other. The second segment 222 is connected between the first segment 221 and the radiation base 20, and is perpendicular to the radiation base 20. As shown in FIG. 1, the first segment 221 is a straight strip with equal width arranged in an X direction, and the second segment 222 is arranged in a Y direction and is in an arc shape with thickness that can vary from broad to narrow width. The width of the second segment 222 is two to three times that of the first segment 221.

(4) The shape of the second ground arm 32 is defined. Herein, the second ground arm 32 is divided into two segments: a connection segment 321 and a hook segment 322, in which the connection segment 321 is between the hook segment 322 and the ground base 30. As shown in FIG. 1, the connection segment 321 is arranged in the Y direction, and is perpendicular to the ground base 30. The hook segment 322 is in a design mode of slightly varying from broad to narrow when bending and extending. The width of the connection segment 321 is about twice that of the hook segment 322 on the whole.

(5) The shape of the first radiation arm 21 is defined. As shown in FIG. 1, the first radiation arm 21 extending out from the radiation base 20 is a straight strip with width varying in thickness (e.g. narrow to broad). Depending on the use of the antenna, the first radiation arm 21 may be in a rectangular shape at two ends and the change of the width (a slope) is chosen in a middle segment of the first radiation arm 21. The maximum width of the first radiation arm's larger end is twice the minimum width of the first radiation arm's smaller end.

(6) The shape of the first ground arm 31 is defined. As shown in FIG. 1, the first radiation arm 31 extending out from the radiation base 30 is a straight strip with width varying in thickness (narrow on one end to broad on the other end). Depending on the use of the antenna, the first ground arm 31 on the ground base 30 may be in a rectangular shape at two ends, and the change of the width (a slope) is chosen in the middle segment of the first ground arm 31. The maximum width of the wider first ground arm end is twice the minimum width of the first ground arm's shorter end. In addition, the first ground arm 31 and the first radiation arm 21 may also be designed to have the same shape or proportional shape and size. Furthermore, in order to improve the impedance matching of the antenna, the lengths of the first radiation arm 21 and the first ground arm 31 may be adjusted.

Figure 2:
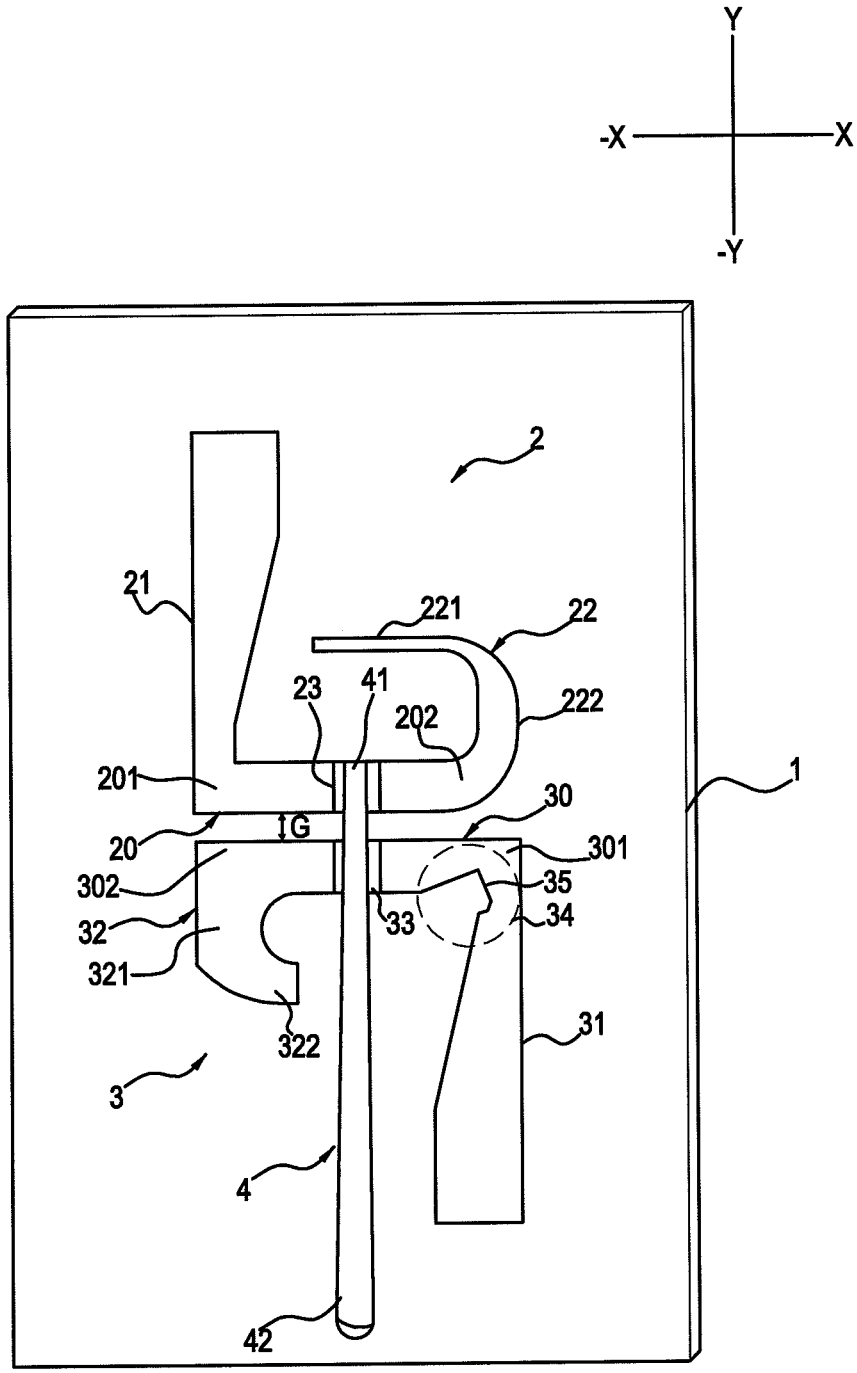
FIG. 2 is a drawing illustrating a second architecture of the asymmetrical dipole antenna according to the embodiment.

FIG. 2 is a drawing illustrating a second architecture of an asymmetrical dipole antenna according to the embodiment. The difference between the second architecture and the first architecture is that a transition portion 34 is formed at a position where the ground base 30 extends to the first ground arm 31, and an indented notch 35 is formed at an inner edge of the transition portion 34 so that antenna gain and impedance matching of the antenna are improved through the indented notch 35. The indented notch 35 may be designed into different shapes according to the impedance matching of the antenna.

Figure 3:
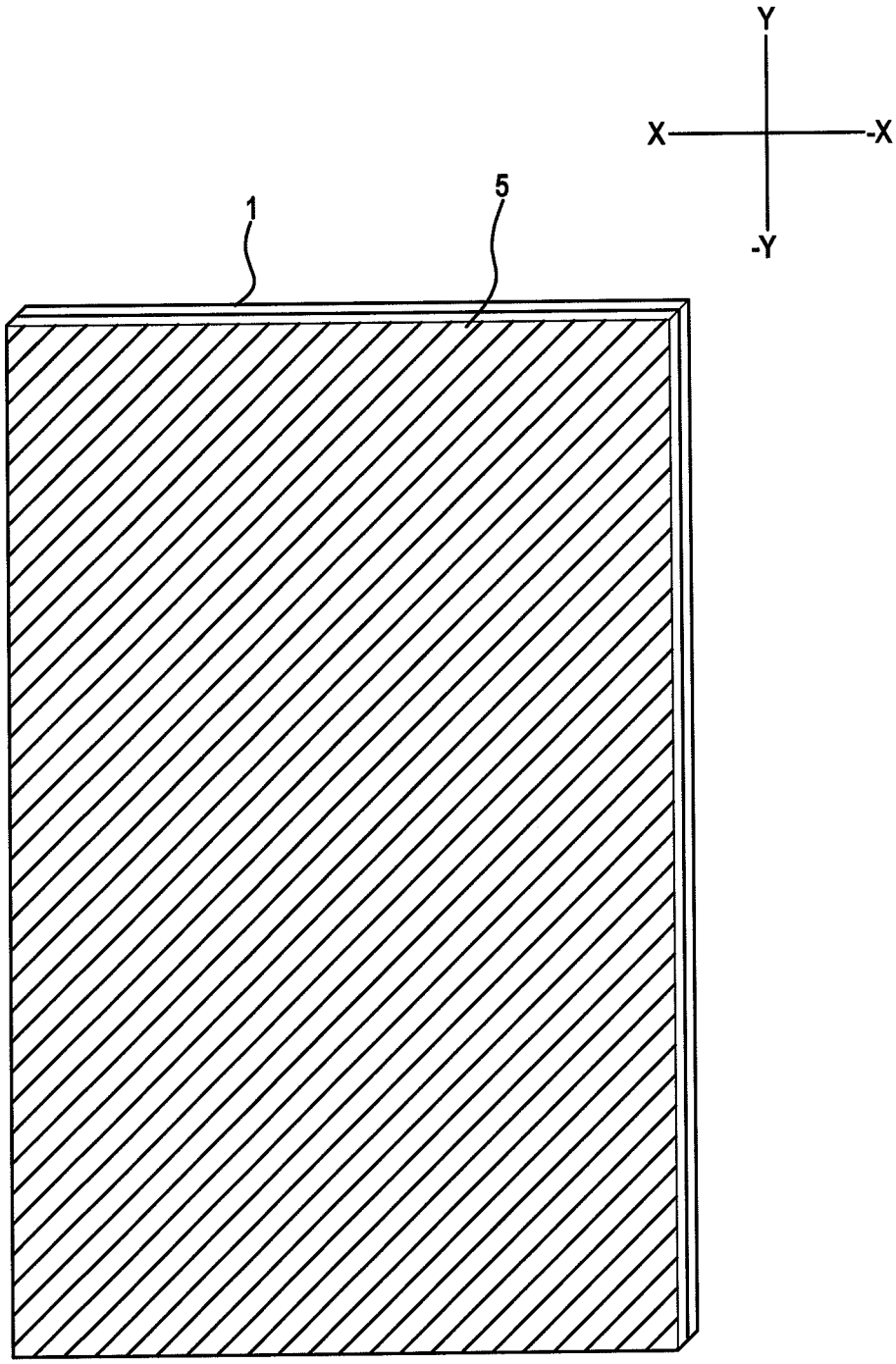
FIG. 3 is a drawing illustrating the substrate surfaces of a third architecture of an asymmetrical dipole antenna according to the embodiment.

FIG. 3 is a drawing illustrating the substrate surfaces of a third architecture of an asymmetrical dipole antenna according to the embodiment. Referring to FIG. 3, the difference between the third architecture and the aforementioned architectures lies in that the substrate 1 has a first surface and a second surface which are opposite to each other. The radiation module 2, the ground module 3, and the feeder unit 4 are arranged on the first surface of the substrate 1, and a reflective layer 5 is arranged on the second surface of the substrate 1.

As shown in FIG. 3, the reflective layer 5 can be wholly distributed throughout the second surface, partially arranged on the second surface, or reticularly arranged on the second surface. It should be noted that the arrangement manner of the reflective layer 5 is dependent upon the requirements of the designer, and is not limited to those arrangements stated above. In addition, many relevant methods exist for forming the reflective layer 5. These methods include, but are not limited to, circuit board etching, molten metal vapor deposition, metal sputtering, metal coating, and coating with sheet metal (tin foil or aluminum foil).

Figure 4A:
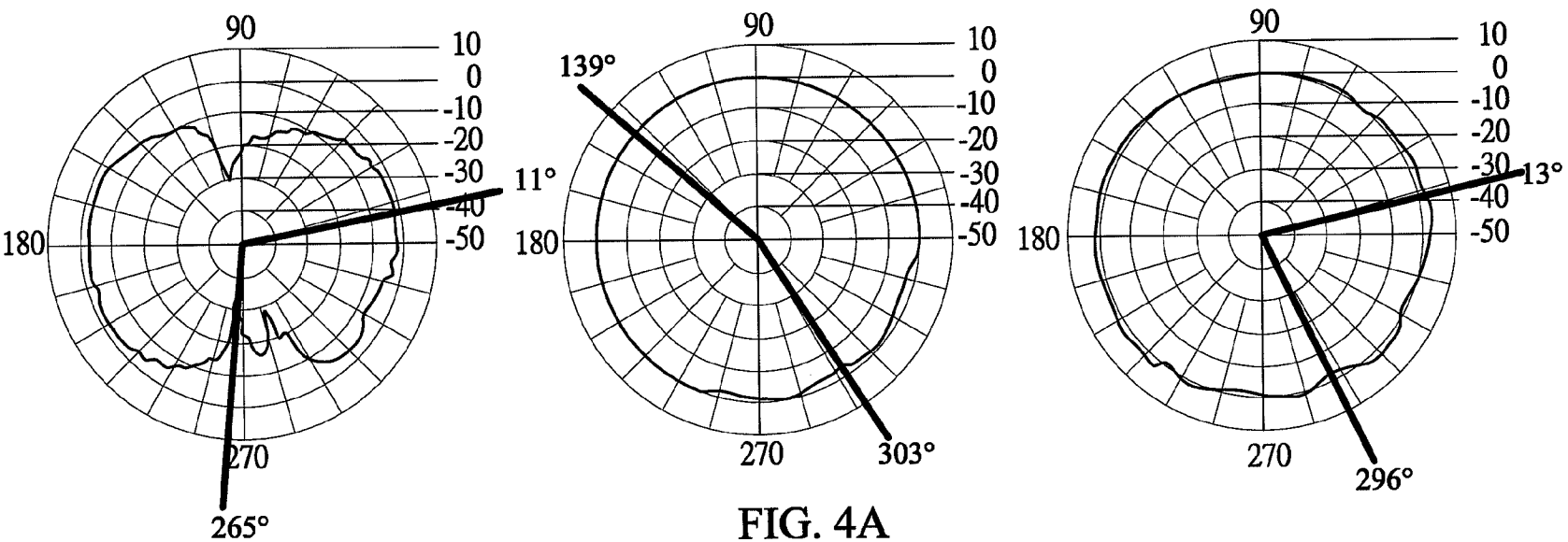
FIG. 4A is a drawing illustrating the correspondence between radiation patterns and vertical signal gain of an asymmetrical dipole antenna according to an embodiment.
Figure 4B:
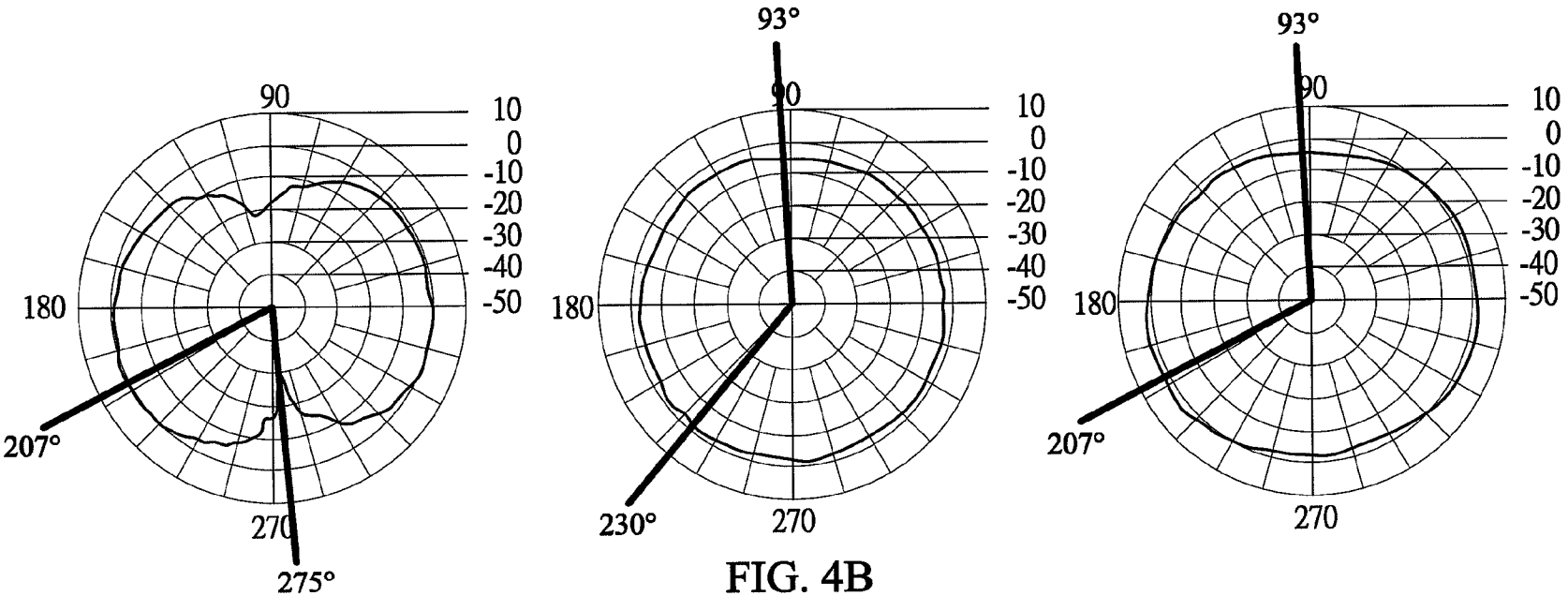
FIG. 4B is a drawing illustrating the correspondence between radiation patterns and horizontal signal gain of an asymmetrical dipole antenna according to an embodiment.

Referring to FIG. 4A to FIG. 4D in turn, they are drawings that illustrate gain of the asymmetrical dipole antenna of the embodiment. FIG. 4A is a drawing illustrating the relationship between radiation patterns and vertical signal gain of the asymmetrical dipole antenna according to an embodiment. A horizontal pattern, a vertical pattern, and an integrated pattern (horizontal+vertical) are respectively shown from left to right. Here, a frequency ranging from WIFI-2.4 GHz to 2.5 GHz is used as a test environment, and test data of the asymmetrical dipole antenna with respect to the vertical signal gain is shown. FIG. 4B is a drawing illustrating the relationship between radiation patterns and horizontal signal gain of the asymmetrical dipole antenna according to an embodiment. A horizontal pattern, a vertical pattern, and an integrated pattern (horizontal+vertical) are respectively shown from left to right. Here, the frequency ranging from WIFI-2.4 GHz to 2.5 GHz is also used as the test environment, and test data of the asymmetrical dipole antenna with respect to the horizontal signal gain is shown.

It can be seen from FIG. 4A and FIG. 4B that, in the frequency range from WIFI-2.4 GHz to 2.5 GHz, the horizontal radiation pattern is relatively weaker at angles 90 degrees and 270 degrees than the other angles, while the vertical radiation pattern is relatively even at all angles. After combining the two radiation patterns, the resulting radiation pattern is also roughly circular and even at all angles. Therefore, the antenna structure has a considerable degree of gain and stability.

Figure 4C:
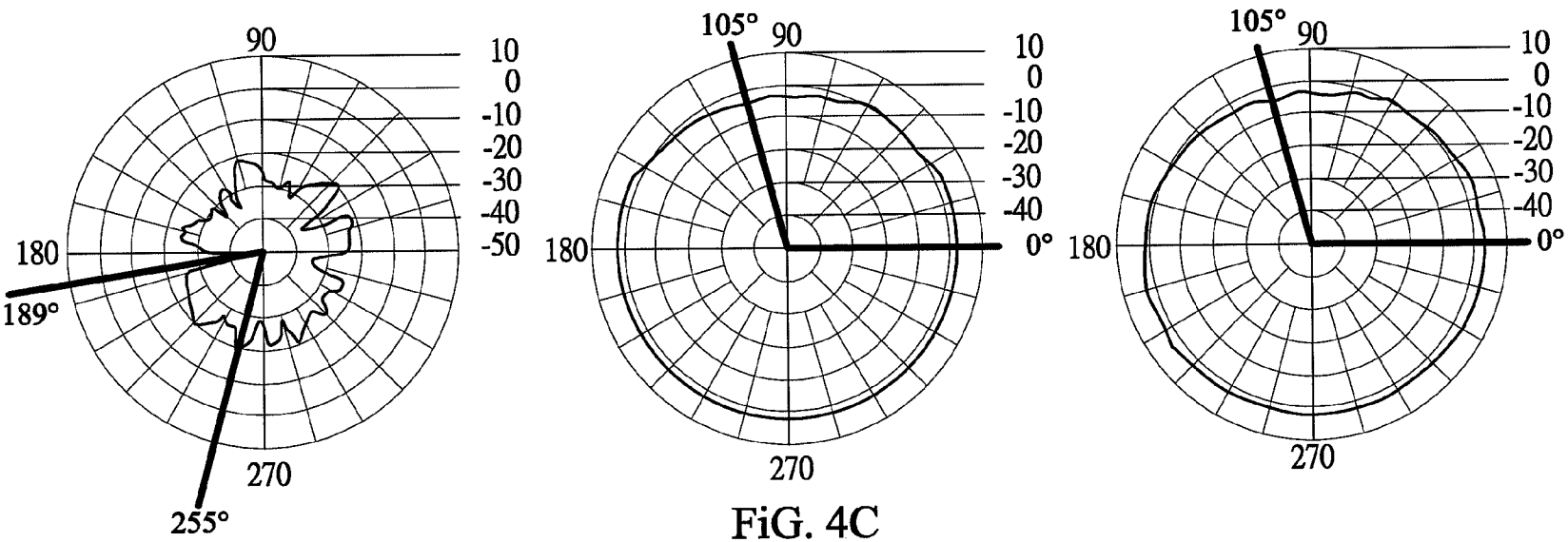
FIG. 4C is a drawing illustrating the correspondence between radiation patterns and vertical signal gain of an asymmetrical dipole antenna according to another embodiment.

FIG. 4C is a drawing illustrating the relationship between radiation patterns and vertical signal gain of the asymmetrical dipole antenna according to another embodiment. A horizontal pattern, a vertical pattern, and an integrated pattern (horizontal+vertical) are respectively shown from left to right Here, a frequency ranging from WIFI-4.9 GHz to 6.0 GHz is used as a test environment, and test data of the asymmetrical dipole antenna with respect to the vertical signal gain is obtained. It can be seen from FIG. 4C that, in the frequency ranging from WIFI-4.9 GHz to 6.0 GHz, the horizontal radiation pattern is highly irregular in shape and varies in concavity and convexity at each angle, while the vertical radiation pattern is relatively circular and even as the whole. After combining the two radiation patterns, the resulting radiation pattern is also roughly even and circular. Therefore, the antenna structure has a considerable degree of gain and stability.

Figure 4D:
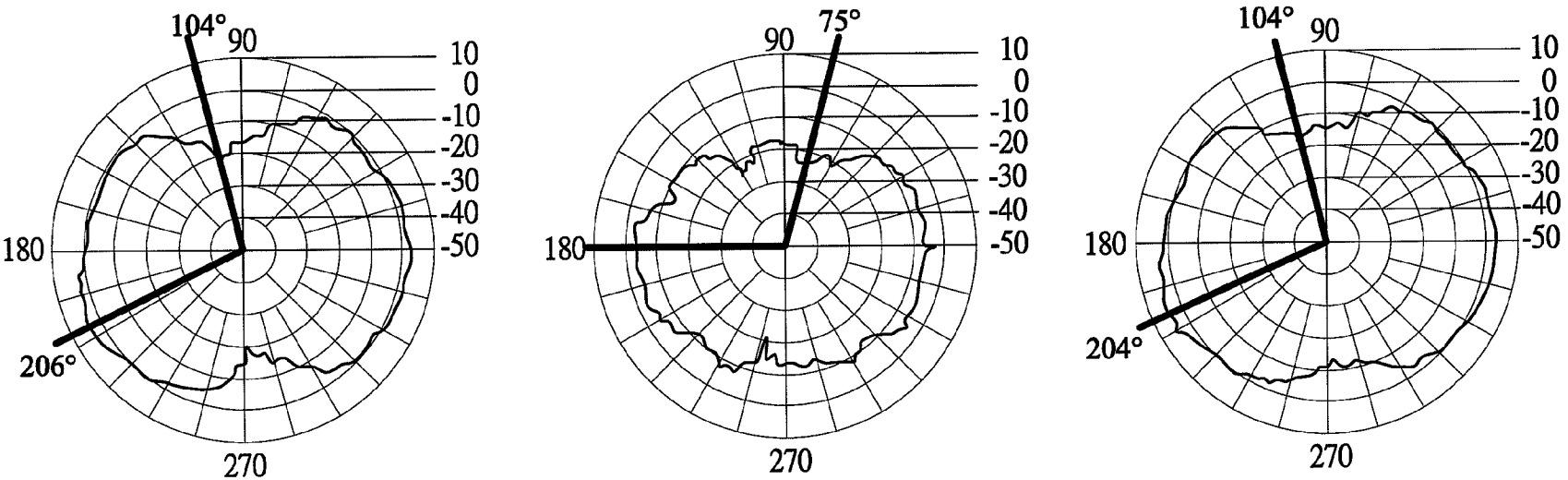
FIG. 4D is a drawing illustrating the correspondence between radiation patterns and horizontal signal gain of an asymmetrical dipole antenna according to another embodiment.

FIG. 4D is a drawing illustrating the relationship between radiation patterns and the horizontal signal gain of the asymmetrical dipole antenna according to another embodiment. A horizontal pattern, a vertical pattern, and an integrated pattern (horizontal+vertical) are respectively shown from left to right. Herein, the frequency ranging from WIFI-4.9 GHz to 6.0 GHz is used as the test environment, and test data of the asymmetrical dipole antenna with respect to the horizontal signal gain is obtained. It can be seen from FIG. 4D that, in the frequency ranging from WIFI-4.9 GHz to 6.0 GHz, the gain of the horizontal radiation pattern and the vertical radiation pattern is slightly reduced at angles 90 degrees and 270 degrees, but after combining the two radiation patterns, the integrated radiation pattern is slightly oval and smoother. Therefore, such antenna structure has a considerable degree of gain and stability in terms of signal reception and transmission and antenna gain.

To those that read this patent, it will be obvious that the embodiment may be varied in many other ways. Such variations are not to be regarded as a departure from the spirit and scope of the disclosure, and all such modifications as would be obvious to one skilled in the art after reading this patent are intended to be included within the scope of the following claims.

What is claimed is:

1. An asymmetrical dipole antenna, comprising:

a substrate;

a radiation module, formed by a first metallic conductor arranged on the substrate, and having a radiation base, wherein a first radiation arm and a second radiation arm extend toward a first direction from two ends of the radiation base in an orthogonal manner, the second radiation arm varies from end to end by broad to narrow width and extends toward the first radiation arm and forms an arc opened toward the first radiation arm with the radiation base, and the radiation base comprises a feed point;

a ground module, aligned with the radiation module at an interval, formed by a second metallic conductor arranged on the substrate, and having a ground base, wherein a first ground arm and a second ground arm are orthogonal to the ground base, and extend toward a second direction from two ends of the ground base, the second ground arm is a hook and extends toward the first ground arm, a ground point is arranged on the ground base corresponding to the feed point, and a transition portion having an indented notch is formed at a position where the ground base extends to the first ground arm; and a feeder unit, for electrically connecting the feed point and the ground point.

2. The asymmetrical dipole antenna according to claim 1, wherein the length from the feed point to the end of the first radiation arm is equal to the length from the feed point to the end of the second radiation arm.

3. The asymmetrical dipole antenna according to claim 1, wherein the length from the ground point to the end of the first ground arm is twice the length from the ground point to the end of the second ground arm.

4. The asymmetrical dipole antenna according to claim 1, wherein the second radiation arm has a first segment and a second segment perpendicular to each other, the second segment connects the first segment and the radiation base and is perpendicular to the radiation base, and the width of the second segment is two to three times that of the first segment.

5. The asymmetrical dipole antenna according to claim 1, wherein the second ground arm comprises a connection segment and a hook segment, the connection segment is connected between the hook segment and the ground base and is perpendicular to the ground base, and the width of the connection segment is twice that of the hook segment.

6. The asymmetrical dipole antenna according to claim 1, wherein the first radiation arm extends from a position where the first radiation arm is orthogonal to the radiation base with one end of the radiation arm being narrow and the other end being broader, and the maximum width of one end of the first radiation arm is twice the minimum width of the other end of the first radiation arm.

7. The asymmetrical dipole antenna according to claim 1, wherein the first ground arm extends from a position where the first ground arm is orthogonal to the ground base and the first ground arm widens from one end to the other end from narrow to broad width, and the maximum width of one end of the first ground arm is twice the minimum width of the other end of the first ground arm.

8. The asymmetrical dipole antenna according to claim 1, wherein the substacte has a first surface and a second surface oppsite to each other, the radiation module is formed by A first metallic conductor arranged on the first surface.

9. The asymmetrical dipole antenna according to claim 8, further comprising a reflective layer, arranged on the second surface.

* * * * *